United States Patent [19]

Andris

[11] Patent Number: 4,886,186

[45] Date of Patent: Dec. 12, 1989

[54] PASTE DISPENSER

[76] Inventor: Raimund Andris, Tannhörnle 9, 7730 Villingen-Shwenningen 22, BRD, Fed. Rep. of Germany

[21] Appl. No.: 175,199

[22] Filed: Mar. 30, 1988

[30] Foreign Application Priority Data

Mar. 30, 1987 [DE] Fed. Rep. of Germany ..... 3710496

[51] Int. Cl.[4] ..... B67D 5/40

[52] U.S. Cl. ..... 222/379; 222/383; 222/386; 222/391; 222/509; 222/531

[58] Field of Search ..... 222/321, 391, 307, 379, 222/380–383, 386, 400.12, 400.13, 522, 523, 505, 509, 526, 531, 94; 267/165, 164

[56] References Cited

U.S. PATENT DOCUMENTS

| | | | |
|---|---|---|---|
| 2,789,731 | 4/1957 | Marraffino | 222/129 |
| 3,879,025 | 4/1975 | Oillard | 267/165 |
| 4,691,847 | 9/1987 | Ford et al. | 222/383 |

FOREIGN PATENT DOCUMENTS

| | | | |
|---|---|---|---|
| 3512650 | 10/1986 | Fed. Rep. of Germany | 222/207 |

*Primary Examiner*—Joseph J. Rolla
*Assistant Examiner*—Steven M. Reiss
*Attorney, Agent, or Firm*—McGlew & Tuttle

[57] ABSTRACT

A dispenser for the delivery of dosed quantities of a pasty substance comprises a receptacle having a push button mounted on the receptacle for movement upwardly and downwardly adjacent an end thereof. A rod extends through the receptacle and is connected at its inner end to a follower plunger. A substance flow tube has one end extending into the receptacle to the reservoir thereof for the pasty substance and an opposite end with a substance delivery orifice which extends out of the receptacle. A closing wall adjacent the tube closes the delivery orifice. The follower plunger is in sliding engagement with interior of the receptacle and it is movably engageable around the rod and is movable along the rod upon discharge of a substance through the delivery orifice. There is a connection between the plunger and at least one of the closing wall and the substance flow tube for shifting one end of the closing wall relative to the flow tube opening the delivery orifice for the delivery of the substance therethrough. The delivery plunger normally moves up the rod member during the dispensing movement effected by movement of the plunger manually. This contributes to the outflow of the pasty substance through the delivery tube and out through the orifice.

9 Claims, 11 Drawing Sheets

PASTE DISPENSER

FIELD AND BACKGROUND OF THE INVENTION

The invention is concerned with a paste dispenser for the delivery of dosed quantities of pasty substances, such as toothpaste. A receptacle of a plastic material has a delivery orifice at one end of the receptacle and a feed piston, or plunger arranged axially movable in the receptacle. The piston can be displaced by means of a manually actuated push-button, or with a follower-piston that can be pushed up by means of a return spring or by atmospheric pressure. The delivery orifice is arranged in a tubular nozzle connection extending along an upper front wall of the receptacle and is closable by a closing wall that is movable at right angles to its axis.

In a paste dispenser described in OS [unexamined German patent application] 35 07 355, a delivery nozzle is shaped as a tubular body, the lower section of which is provided with an inside thread and which is screwed onto a tubular hollow base of a displacement piston, while its upper section runs obliquely to the axis of the receptacle, at an angle of approximately 30°. The delivery orifice is closable or is closed by a closing wall movable at right angles to its axis, and it is a one-piece component of a rocker-type actuating lever. This actuating lever is pivoted on pivot pins of the delivery nozzle through tongue-shaped sections and is arranged in such a manner that these tongues are supported by transverse collars of the housing, when the press key is tilted about the axis of the pivot pins in the direction of an opening movement. Through this support, an axial displacement of both the delivery nozzle and of the displacement piston are effected during the opening movement. To return the displacement plunger as well as the delivery nozzle and the actuating lever to their starting positions, a metal compression spring is arranged between the bottom front flange surface of the tubular body forming the delivery nozzle and an annular supporting surface.

Disregarding a protecting cap and a base disk that are provided, this paste dispenser is composed of a total of seven component parts.

A dosed dispensing of the medium inside the receptacle is provided with certainty only when there are no air cushions or air bubbles in the reservoir of the receptacle, since air can be compressed. Because paste dispensers of this kind are produced in very large quantities as mass and disposable articles, and should therefore be producible at the lowest possible cost and with the lowest quantity of material required, each additional component part means additional total costs and assembly costs, thus raising the production costs.

SUMMARY OF THE INVENTION

The invention provides a paste dispenser which can be easily operated by anyone, in a reliable way, with one hand, and which, inasmuch as it concerns a mass product manufactured in the millions and to be discarded after a single use, comprises as few component parts as possible, and which can be manufactured at the lowest possible expense in material, tool and assembly costs.

According to the invention, the delivery orifice is arranged facing in a radially outward direction at least at approximately right angles to axis of the receptacle. A closing wall has a section which at least in the area of the delivery orifice adjoins closely the outside of the nozzle connection and the edge of the delivery orifice, in a position parallel to the axis of the receptacle and in such a manner that the delivery orifice is opened by movement of either nozzle connection or the closing wall. This movement is generated by way of the push button and runs parallel to the axis of the receptacle.

In the known paste dispenser, actuating the actuating lever also causes an axial movement of the element corresponding to the nozzle connection, namely the delivery nozzle. However, this is effected by a rotating motion of the actuating lever, which is necessary in order to swing the closing wall in an opening direction transversely to the axis of the delivery orifice. A lifting of the piston that is thereby created is therefore only about half as much as the motion-path of the key lever.

The advantage of the design of the paste dispenser according to the invention is that at least one component part less is required in many different specific embodiments, and in some cases even three component parts less than in the known paste dispenser. Also, in all specific embodiments of the past dispenser of the invention, the component parts can be assembled in a considerably simpler manner, i.e. at considerably lower assembly costs, because no threaded connections are provided. In the known paste dispenser, the connection between the hollow boss and the bottom section of the delivery nozzle can be established only by means of a thread, which can be made only when the delivery nozzle stands still and the hollow boss can be screwed with its external thread into the inside thread of the delivery nozzle from below through turning of the displacement plunger. It is obvious that the assembly of the component parts is thereby made more difficult and more expensive.

The paste dispenser according to the invention has an additional advantage in that, the actuating button, a delivery piston, or a follower piston can be actuated simultaneously by means of a push rod, which is not provided in the known paste dispenser and is not possible in it, either.

The possibility exists of either arranging the nozzle connection at the upper front wall of the container, axially movable, and to attach the closing wall to the receptacle, axially immovable, or arranging the nozzle connection at the upper front wall of the container in a stationary manner and providing an axially movable closing wall at the nozzle connection.

In either case, it is appropriate and advantageous with respect to the production costs, when the respective movable part is connected with the push button in one piece.

The arrangement of the invention is also functionally of importance in that through a delayed action coupling it is achieved that the delivery movement of the delivery piston and thus the delivery pressure in the receptacle begins only when the delivery orifice is at least partially open. Excess pressures are thereby avoided, which could lead to uncontrolled escapes of paste through the delivery orifice.

The manner in which the solution principle according to the invention can be realized also in such paste dispensers in which the discharge of paste may be effected directly by way of a movement of the piston, but rather with the aid of a displacement element and in which the plunger merely performs a following movement.

Accordingly, it is an object of the invention to provide a dispenser for the delivery of dosed quantities of a pasty substance which comprises a receptacle which has an interior reservoir for the pasty substance and which has a push button mounted on the receptacle for movement upwardly and downwardly adjacent an end thereof and includes a rod which extends through the substance and is engageable at its lower end with a follower piston. The construction including a substance flow tube which has one end extending into the receptacle to the reservoir for the pasty substance and an opposite delivery end or discharge opening which extends out of the receptacle and includes a closing wall adjacent to closing the delivery orifice which is openable by the manual movement of the push button which is connected to at least one of the closing wall and the substance flow tube for shifting one relative to the other for opening the delivery orifice for the discharge of the substance therefrom.

A further object of the invention is to provide a method of dispensing materials from a container which includes a movable piston and a delivery tube having a delivery orifice which comprises arranging the push-button so that movement thereof will affect movement of the delivery tube or a closing wall for its delivery orifice relative to each other and the generation of a pressure within the reservoir of the receptacle to ensure that pasty material is delivered up through the delivery tube when the closing wall is moved out of the closing position closing a delivery orifice of the tube.

A further object of the invention is to provide a device for dispensing pasty substances which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention is illustrated.

DESCRIPTION OF THE PREFERRED EMBODIMENTS

Figure 1:
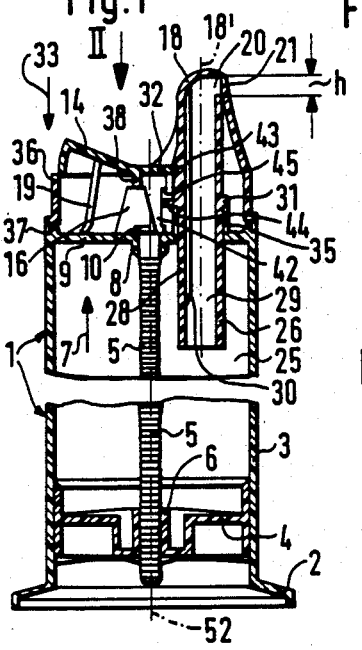
FIG. 1 is a sectional view of a complete paste dispenser constructed in accordance with the invention.
Figure 2:
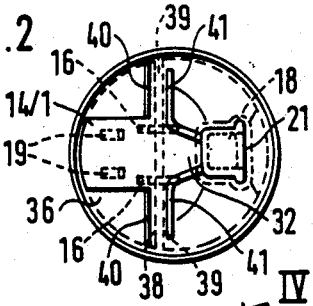
FIG. 2 is a top end horizontal view of the dispenser of FIG. 1.
Figure 3:
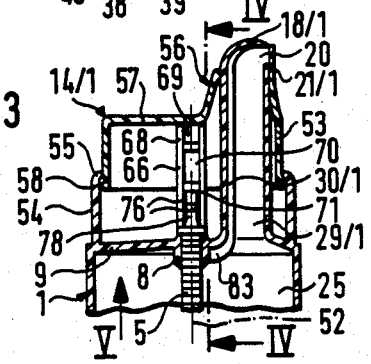
FIG. 3 is a sectional view of a headpiece for another embodiment of paste dispenser.

Referring to the drawings in particular, the invention embodied therein comprises a dispenser for the delivery of dosed quantities particularly a pasty substance which is contained in a reservoir 25 of a receptacle 1 which has a push button or mounted on its top end for displacement in respect to the receptacle 1. In the embodiment of FIGS. 1 to 3, a rod 5 extends through the receptacle and is connected at its lower end to a delivery piston 4 which is advanceable upwardly along the rod through a detent connection established therebetween upon movement of a plunger or push button 14. In accordance with the invention, the substance flow tube 18 has one end extending into the receptacle reservoir 25 and an opposite end with a substance delivery orifice or discharge opening 20 which extends out of the receptacle. A closing wall 21 adjacent the tube 20 closes the delivery orifice in a non-actuated position. Means are connected between the or push button 14 and at least one of the closing wall 21 and the substance flow tube 18 for shifting one relative to the other for opening the delivery orifice for the discharge of the substance from the reservoir 25. This discharge is also aided by the fact that the discharge piston 4 moves upwardly along the rod 5 to either to the displacement of the rod 5 by the push button 14 by a mechanical connection or by the action of pressure forces caused by the downward movement of the push button 14 as in the embodiment of FIG. 7.

In all the exemplified embodiments described below, the paste dispenser has a cylindrical receptacle 1 which is provided with an extended widened pedestal 2. The bottom side of the receptacle can be open or be closed by a bottom that does not close tightly. Functionally, such a bottom is of no importance. In all the exemplified embodiments, there is also movably present in receptacle 1 either a delivery piston 4 or a follower plunger 89 which adjoins the inside of the receptacle wall 3 fitting tightly all around.

In the exemplified embodiments of FIG. 1 through FIG. 6, this delivery plunger is actuated by a toothed push rod 5 which extends through a central piston boss 6 and acts together with it through a directional safety catch 11 in such a manner that during an upward movement of the push rod 5 in the direction of arrow 7, the delivery piston 4 is carried upwards, while a following downward movement of the push rod 5 takes place with delivery piston 4 arrested. To actuate push rod 5, various actuating means are provided in the exemplified embodiments of FIGS. 1 and 2, as well as FIG. 3, 4, 5, and 6. However, both exemplified embodiments have in common that the push rod 5 is in each case guided axially movable in a central guide boss 8 of a housing front wall 9 and that the downward movement of push rod 5 is restricted by an annular flange 10 seated on the top side of the receptacle's front wall 9.

In the exemplified embodiment of FIG. 1 and 2, an axially movable, tubular nozzle connection 18 is provided, with a delivery orifice 20 pointing radially outwardly. This nozzle connection 18 is aligned eccentrically to the receptacle axis 5 of receptacle 1, and form-lockingly connected with a push button 14 which has two tongue-like return springs 19 seated on the front wall 9 of the housing and which hold the push button 14 in its resting position. To guide the axially movable nozzle connection 18, the front wall 9 of the housing is provided with a guide boss 35 arranged eccentrically to receptacle axis 52. On guide boss 35 is seated a collar 31 of nozzle connection 18 in its resting position. A closing wall 21, serving to close the delivery orifice 20, is a component of a partially cylindrical housing attachment 36 which is placed immovably and form-lockingly engaged on a stop ring 37 of receptacle 1. The push button 14 is provided with a transverse pivot rib 38 which is pivotably seated on two support ribs 16 of the front wall 9 of the housing. As can be seen from FIG. 2, the pivot rib 38 extends across the entire width of the housing attachment 36 and ends at the two almost diametrically opposite cylindrical wall sections of housing attachment 36, where they in each case form one piece. The push button 14 is thus a one-piece component of housing attachment 36, with the sections of pivot rib 38 situated outside the support ribs 16 provided in each case with flat bridge 39 attached in T-shape manner. These flat bridges 39, just as the rest of the push button contour, are surrounded on both sides by slots 40 and 42, so that they can perform a torsional movement when the button is actuated.

It can be seen from FIG. 2, that the nozzle connection 18 has a flat external surface at the side of the delivery orifice 20 and that the closing wall 21 tightly adjoins this outside surface over its entire width.

The push button 14 is provided with a pressure shoulder 32 seated on a headpiece 42 of push rod 5. This pressure shoulder 32 is shaped in such a manner that it extends form-lockingly into a groove-shaped radial recess 43 of nozzle connection 18 and that nozzle connection 18 is moved axially in the direction of arrow 7 when the push button 14 is actuated in the direction of arrow 33. Upon this actuation of push button 14 in the direction of arrow 33, it is pivoted on the axis of rotation of the two pivot ribs 38. Thereby, there is initially obtained an axial displacement of the nozzle connection 18 in the direction of arrow 7 under simultaneous opening of the delivery orifice 20.

Delayed carrying along of push rod 5 then takes place by a tongue-shaped projection 44 which is attached to and forms one piece with nozzle connection 18, pointing towards headpiece 42 of push rod 5; said projection 44 grasps a shoulder 45 of headpiece 42 from below, when the delivery orifice 20 is opened by at least one half of its height h, in order to afterwards move upwards the push rod 5 with the delivery plunger 4 during the further upward movement of nozzle connection 18. By this move of the plunger, a part of medium situated in receptacle 1 between the delivery plunger 4 and front wall 9 of the housing is forced out from the delivery orifice by the nozzle connection 18. When push button 14 is released again, the return springs 19 see to the return of both the nozzle connection 28 and the push rod 5 into their resting position, in which the delivery orifice 20 is closed by the closing wall 21. The section 26 of the nozzle connection 18 extends into the reservoir 25 of receptacle and is provided with radial boreholes 28 and guide ribs 30. They serve to feed to the strand of paste flowing through the nozzle connection 18, in a manner known as such, stripe-like smaller quantities of a differently colored second paste situated in the area of the front wall extension.

In order to obtain that the differently colored stripes in the strand of paste will exit from the delivery orifice 18 with as sharp as possible contours, there are arranged in the canal 29 of the nozzle connection 18, alongside the boreholes 28, guide ribs 30 which extend at least approximately to the delivery orifice 20 of nozzle connection 18.

Through the pressure shoulder 32 seated on the front surface of the headpiece of push rod 5, the push rod 5 is pushed axially downward into its starting or resting position by the resting delivery plunger during the return movement of the actuated and then released push button, while the delivery plunger 4 itself remains in its position by virtue of the atmospheric pressure acting on it from below.

While in the thus far described exemplified embodiment the nozzle connection 18 is arranged axially movable and the closing wall 21 is stationary, the exemplified embodiments described herein following with the aid of FIG. 3 through 7, display in each case a tubular nozzle connection 18/1 respectively 18/2 with a delivery orifice 20 directed radially outward, which is stationary, and is formed as one piece with the front wall 9 of the housing. Opening and closing of the delivery orifices 20 of these nozzle connections 18/1 respectively 18/2 takes place, in each case, by an axially movable closing wall 21/1 respectively 21/2. In these exemplified embodiments, too, the nozzle connection 18/1 and 18/2 is in each case arranged eccentrically to the receptacle axis 52, as previously described.

In the exemplified embodiment of FIG. 3 through 6, the nozzle connection 18/1 shaped in one piece at the front wall 9 of the housing of receptacle 1 is provided with a closing wall 21/1 which is a one-piece component of an essentially cylindrical sleeve 53 which is arranged axially moving in a collar 54 extending over the front wall 9 of the housing on the front side, between the front wall 9 of the housing and a inwardly protruding shoulder 55 of collar 54. The closing wall 21/1 thereby forms one side wall of a pyramid-like attachment 56 of front wall 57, the outside surface of which is simultaneously the actuating surface, so that the entire sleeve 53 in this case forms the push button 14/1. So that the sleeve 53 can no longer become detached from collar 54, it is provided with a stop ring 58 gripping under the shoulder 55.

Figure 4:
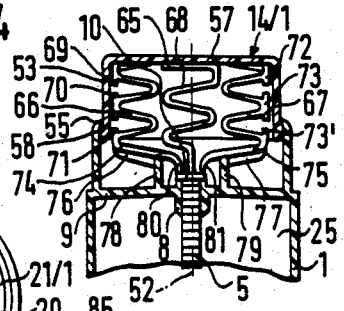
FIG. 4 is a section taken along the line IV—IV of FIG. 3.

As can best be seen from FIG. 4, three strip-shaped compressing springs 66, 67 and 68, running in zig-zag form and connected to one another by a common crossbar 65, are attached to the top end of push rod 5 to form a single piece with it. While the center strip-shaped compression spring 68 performs the function of a return spring and thus has the task of pushing back the push rod 5 to its starting position shown in FIG. 4 and 5, the two outside strip-shaped compression springs 66 and 67 are somewhat narrower and at their respective outside arc sections are provided with respective vertical reinforcing ribs 69, 70 and 71 and 72, 73 and 73', which, when they clash against one another when push button 14/1 is pressed down, cancel out the elasticity of these springs. The respective legs 74 and 75 of the strip-shaped compression springs 66 and 67 are shaped by means of lateral stiffening ribs 76 and 77 into bending-resistant double levers which are seated rocking-like on a vertical reinforcing rib 78 respectively 79 of front wall 9 of the housing and are connected to the push rod 5 by thinner strip sections 80, 81 that are elastic to bending. By virtue of this arrangement, when the push button 14/1 is actuated, an idle stroke is initially effected before the push rod 5 is lifted up, by which the delivery orifice 20 is opened as a result of the downward movement of closing wall 21/1, until the reinforcing ribs 69 to 73 clash with one another in pairs and upon further downward movement, the lever effect at legs 74 and 75 begins, which pulls the push rod 5 upwards and by which the latter is pulled upwards with the delivery piston 4 over the strip sections 80 and 81.

After the push button 14/1 is released, the strip-shaped compression springs 66, 67 and 68 cause the closing of the delivery orifice 20 by the closing wall 21/1 and the return of the push rod 5 to the starting position, in that they again push the push button 14/1 upwards until the stop ring 58 again adjoins the shoulder 55.

Figure 5:
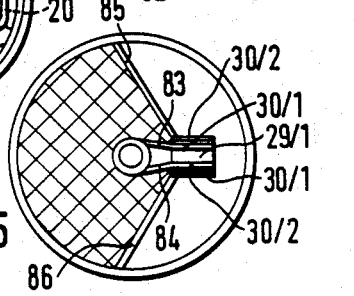
FIG. 5 is a sectional view in the direction V of FIG. 3.

While in the exemplified embodiment of FIG. 1 and 2, in which the nozzle connection 18 is arranged axially movable, there is a bottom section which extends into the reservoir 25 of receptacle 1, such a section of nozzle connection 18/3 extending into the reservoir of receptacle 1 is absent in the exemplified embodiments of FIG. 3 through 5. However, in order that in this exemplified embodiment with a stationary nozzle connection 18/3, it will also be possible to produce in the paste strand leaving the delivery orifice 20 sharply contoured stripes of a differently colored second paste, the front wall 9 of the housing in the exemplified embodiment of FIG. 3 through 5 is provided on its inside with two guide ribs 83 and 84 leading from the guide boss 8 to the canal 29/1 of nozzle connection 18/3, which guide ribs are continued in guide ribs 30/1 through canal 29/1 to the delivery orifice 20. By means of the guide ribs 83 and 84 arranged at the bottom side of front wall 9 of the housing it is attained that a second, differently colored medium, which is to be used to create the stripe and which in the cross-hatched segment of the inside of front wall 9 of the housing in FIG. 5 is present in a layer only a few millimeters thick, can flow to the canal 29/1 of nozzle connection 18/1, which in this case is provided with a square cross-section, not over its entire breadth but only outside these guide ribs 83 and 84, with a guide rib 30/2 extending in the canal being arranged outside each of the guide ribs 30/1 that also extend in the canal at a slight lateral distance from the former. Guide ribs 30/1 and 30/2 form within the canal 29/1 stripe canals for paste of another color. These guide ribs 30/2 are joined to oblique guide ribs 85 and 86 arranged on the inside of the front wall, which delimit the receiving space of the second, differently colored paste and favor the strip-like feeding of this paste to canal 29/1.

Figure 7:
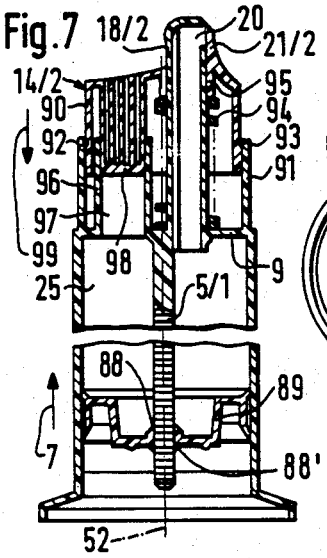
FIG. 7 is a sectional view of still another embodiment of paste dispenser.
Figure 6:
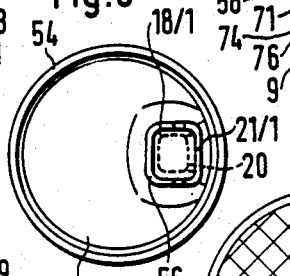
FIG. 6 is a horizontal view of the dispenser shown in FIG. 3.

The paste dispenser shown in FIG. 7 differs from the paste dispensers described above with the aid of FIGS. 1 through 6, basically by that the ejection of paste is not effected through the upward movement of a delivery piston 4, but through actuating a displacement element which is connected with the reservoir 25 of receptacle 1.

In the exemplified embodiment of FIG. 7, a nozzle connection 18/2 is provided connected to front wall 9 of the housing to form one piece with it, and running paraxially to the axis 52 of the receptacle. To the nozzle connection, a climbing push rod 5/1 is attached to form one piece with it, which extends coaxially to the axis 52 of the receptacle downward through the receptacle. Both the nozzle connection 18/2 and the climbing rod 5/1 are thus arranged stationary in respect to the receptacle front wall 9. The climbing rod 5/1 has a cylindrical section and extends through a boss bore 88 of the follower piston 89 which rests on the climbing rod 5/1 by means of a compression spring 88, forming a ratchet clutch, in such a manner that it can only move upward in the direction of arrow 7 namely to the extent that receptacle 1 is emptied by the nozzle connection 18/2.

As in the other already described examples, here the nozzle connection 18/2 is also arranged eccentrically to axis 52 of the receptacle and is provided with a radially outward pointing delivery orifice 20 which is closed by a movable closing wall 21/2 which tightly adjoins the external surface of nozzle connection 18/4. This closing wall 21/2 is a one-piece component of a sleeve 90 enclosing the nozzle connection, which, similar to sleeve 53, is situated movable axially up and downward in a cylindrical collar 91 attached to front wall 9 of the housing, and which forms the push button 14/2. To limit the axial movement of sleeve 90, the collar 91 is provided at its upper end with an inner annular rib 92, adjoining which there is an annular shoulder 93 of sleeve 90, when the latter is in its resting respectively closing position shown in FIG. 7. By means of a spiral spring 94, which surrounds the nozzle connection 18/2 and is arranged between the front wall 9 of the housing and a guide boss 95 of sleeve 90, the sleeve 90 is held in the closing position or is again brought into the closing position after being actuated, respectively. Diametrically opposite the nozzle connection 18/2 a cylindrical pipe socket 96 is arranged at the front wall 9 of the housing, the inside space 97 of which is connected directly to the reservoir 25 of receptacle 1. In this pipe socket 96, there is a piston 98 formed as one piece with sleeve 90 and serving as the displacement element. Upon each manually actuated downward movement of sleeve 90, i.e., of the push button 14/2 in the direction of arrow 99, the paste situated in the hollow space 97 of pipe socket 96 is pressed into the reservoir of receptacle 1, from which an appropriate quantity of paste is conveyed to the outside through nozzle connection 18/2. The closing wall 21/2 moves downward simultaneously with sleeve 90 and the push button 14/2, and releases the delivery orifice of nozzle connection 18/2. During this downward move of sleeve 90, and the push button 14/2, the follower piston 89 cannot move downward because it is held against the climbing rod 5/1 by the brake 88, However, when after the release of push button 14/2 the compression spring 94 moves the plunger 98 with the closing wall 21/2 upward again and the delivery orifice is thereby closed, a vacuum is created in the area of hollow space 97, which causes the paste to flow from reservoir 25 of receptacle 1 to the hollow space 97, in that a corresponding upward movement (climbing movement) of follower plunger 89 in receptacle 1 takes place by virtue of the atmospheric pressure acting on follower plunger 89.

The height of lift of sleeve 90 respectively of push button 14/2 is at least double as much as the axial height h of the delivery orifice 20 only when it is completely open. At the beginning of the upward movement of sleeve 90, the strand of paste in the nozzle connection 18/2 will move slightly backwards due to the suction effect produced by the plunger 98, so long as the delivery orifice is not yet completely closed again.

In all the exemplified embodiments, an automatic opening and closing of the delivery orifice 20 takes place through the axial relative motion between a closing wall 21, 21/2, 21/2 and a nozzle connection 18, 18/1, 18/2, when the push button is actuated or released again, respectively.

While specific embodiments of the invention have been shown and described in detail to illustrate the application of the principles of the invention, it will be understood that the invention may be embodied otherwise without departing from such principles.

What is claimed is:

1. A paste dispenser for the delivery of dosed quantities of pasty substances such as toothpaste and similar materials, comprising a substantially cylindrical receptacle having a receptacle delivery tube with a delivery orifice adjacent its one end and which has an opposite end extending into said receptacle, a feed plunger arranged axially movable in said receptacle and having a manually operable push button portion for displacing said plunger, biasing means biasing said push button to a return position, a closing wall of said receptacle positioned adjacent said tubular member so as to close said delivery orifice, said delivery orifice being arranged facing in a radially outward direction at substantially right angles to an axis of said receptacle, said closing wall having a portion which at least in the area of said delivery orifice adjoins closely the outside of said tubular member in a position parallel to the axis of said receptacle, said delivery orifice being opened by movement of at least one of said tubular member and said closing wall, said push button being connected to at least one of said tubular member and said closing wall so as to move one relative to the other parallel to the axis of said receptacle, including a push rod centrally located in said receptacle and extending through the interior of said receptacle forming a reservoir, said push rod having a lower end connected to a delivery piston, said connection comprising a ratchet clutch, said delivery piston engaged around said push rod in the reservoir of said receptacle, said push rod having a lateral projection which engages said tubular member, said tubular member having a stop which is positioned to engage against said push rod, said push rod projection forming a lifting shoulder which engages against said stop arranged at substantially half the delivery orifice opening.

2. A paste dispenser according to claim 1, wherein said push button and said tubular member having said delivery nozzle are connected to each other to form a single piece, and wherein said closing wall is attached to said receptacle to form a single piece with said receptacle.

3. A paste dispenser according to claim 1, wherein said push button and said closing wall are connected to each other to form a single piece.

4. A dispenser for the delivery of dosed quantities of a substance, comprising a receptacle, a push button mounted on said receptacle for movement upwardly and downwardly adjacent an end of said receptacle, a rod extending through said receptacle, a substance flow tube having one end extending into said receptacle and an opposite end with a substance delivery orifice extending out of said receptacle, a closing wall adjacent said substance flow tube closing said delivery orifice, a piston in sliding engagement with an interior of said receptacle and being movably engageable around said rod and being movable along said interior of said receptacle upon discharge of a substance through said delivery orifice, and means connected between said push button and at least one of said closing wall and said substance flow tube for shifting one of said closing wall and said substance flow tube axially relative to the other for opening said delivery orifice for the discharge of the substance therefrom, a plurality of compression spring elements formed between said push button and said rod, said springs situated diametrically opposite to the axis of said receptacle, a cross bridge connecting the ends of said springs together having an externally situated arc section provided with reinforcing ribs limiting the action of said springs to the defined path of movement of said ribs, said ribs having bottom sections which are shaped as bending resilient lever arms which are seated in axial reinforcing rib portions of said housing wall.

5. A paste dispenser according to claim 4, wherein said push button has a closing wall with a guide collar axially movable against a return spring and is connected to the reservoir of said receptacle by means of a displacement element.

6. A past dispenser according to claim 5, wherein said displacement element has a form of a lifting plunger which extends through an opening in the top of said receptacle.

7. A paste dispenser according to claim 4, including a third strip shaped compression spring in zig-zag form arranged between said bendable strip shaped compression springs and connected to said push button and including a cross bridge, said third strip shaped compression spring having a spring path longer than said limited spring path of said two other strip shaped compression springs that are provided with reinforcing ribs.

8. A paste dispenser according to claim 4, wherein said receptacle has an interior wall connected to said tubular member and is provided with guide ribs which form narrow strip shaped canals.

9. A paste dispenser according to claim 4, wherein the bottom sections have reinforcing ribs making the bottom sections rigid and inflexible.

* * * * *